US005829731A

United States Patent [19]

Dean

[11] Patent Number: 5,829,731

[45] Date of Patent: Nov. 3, 1998

[54] FOLDING HOLDER FOR FLAGPOLE

[75] Inventor: LeRoy L. Dean, Everett, Wash.

[73] Assignee: Patriot LLC, Everett, Wash.

[21] Appl. No.: 865,283

[22] Filed: May 29, 1997

Related U.S. Application Data

[63] Continuation-in-part of Ser. No. 778,903, Jan. 3, 1997.

[60] Provisional application No. 60/009,663 Jan. 5, 1996.

[51] Int. Cl.[6] ..... G09F 17/00

[52] U.S. Cl. ..... 248/538; 116/173; 248/292.13; 248/534

[58] Field of Search ..... 248/514, 534, 248/538, 291.1, 292.3; 116/173

[56] References Cited

U.S. PATENT DOCUMENTS

| | | | |
|---|---|---|---|
| 1,285,218 | 11/1918 | Kershaw . | |
| 1,467,621 | 9/1923 | Mahoney | 248/534 |
| 1,523,042 | 1/1925 | Thomas | 248/538 X |
| 1,677,379 | 7/1928 | Ames | 248/538 |
| 2,636,707 | 4/1953 | Baker . | |
| 2,719,687 | 10/1955 | Hiscock | 248/534 X |
| 2,828,098 | 3/1958 | Lehmann . | |
| 3,599,599 | 8/1971 | Jones | 116/173 |
| 4,090,468 | 5/1978 | D'Spain . | |
| 4,274,127 | 6/1981 | Beck et al. | 116/173 X |
| 4,920,910 | 5/1990 | Lin . | |
| 4,976,410 | 12/1990 | Tomaindo | 248/514 |
| 5,137,240 | 8/1992 | Van Meter . | |
| 5,156,110 | 10/1992 | Fuller . | |

*Primary Examiner*—Leslie A. Braun
*Assistant Examiner*—Derek J. Berger
*Attorney, Agent, or Firm*—Lyon & Lyon LLP

[57] ABSTRACT

A flagpole holder which folds flat against the wall when not in use. A spring-loaded hook releases a cover member which pivots outwardly and upwardly to an extended position in which the flagpole is passed through an opening in the support. The lower end of the flagpole enters a receiving area in the base plate and is engaged by the upwardly attentioned hook portion which previously held the cover closed.

14 Claims, 5 Drawing Sheets

40
10
20
30
5
50

FOLDING HOLDER FOR FLAGPOLE

This application is a continuation-in-part of pending application Ser. No. 08/778,903, filed Jan. 3, 1997 and entitled FOLDING HOLDER FOR FLAGPOLE, which claims the benefit of provisional patent application Ser. No. 60/009,663, filed Jan. 5, 1996 and entitled FOLDING HOLDER FOR FLAGPOLE.

FIELD OF THE INVENTION

The present invention relates generally to devices used to hold or display flags and, more particularly, to a flagpole holder which folds to form a compact, non-intrusive structure when not in use.

BACKGROUND OF THE INVENTION

The most common method used to display flags is a flagpole, with the base of the flagpole being inserted into some form of stand or holder. Since most of these devices engage the flagpole only at or near its end, they must be sufficiently strong and/or heavy to provide adequate support.

Flagpole holders having these characteristics, however, generally present the problem of an obtrusive appearance when not in use. For example, schools, public buildings, and meeting halls may have an interior display of one or more flags on certain occasions, yet not want to have brackets or other supports projecting from the walls while the flags are not on display; such facilities have generally resorted to the use of heavy portable based which are a cumbersome nuisance to deal with. In another context, it is common practice to display flags on the exterior of trailers and motorhomes at RV parks and meets, but it is undesirable to have a fixed flagpole bracket which will continue to project from the side of the RV when the flag is not in use and the vehicle is possibly in motion.

Some prior flagpole holders have attempted to solve these problems by using a two-piece design. U.S. Pat. No. 5,156,110 (Fuller) is an example of the two-piece approach. This approach, however, brings the inconvenience of having to disassemble and store the removed portion after each use, and the inconvenience of having to find the stored portion and reassemble the holder at the next use.

U.S. Pat. No. 4,920,910 (Lin) shows an adjustable flag holder in which the angle of the flag can be adjusted by loosening a wing nut so as to pivot a block piece (31).

U.S. Pat. No. 1,285,218 (Kershaw) shows a device somewhat similar to that in Lin, in which a wing nut is used to loosen/tighten a ball and socket joint by which the angle of the flagpole can be adjusted.

The remaining references do not disclose anything with regard to flagpoles or the display of flags, and are therefore believed to be of only background interest with respect to the present invention.

U.S. Pat. No. 5,137,240 (Van Meter) shows an apparatus in which there is a slotted plate (51) which can be pulled out from the wall to form a footrest for tying shoes.

U.S. Pat. No. 3,977,637 (Newton) shows an adjustable angle holder for a fishing rod.

U.S. Pat. No. 2,636,707 (Baker) shows another foldable bracket for attachment of an appliance, such as the meat grinder which is shown in FIG. 6.

Accordingly, there exists a need for a flagpole holder which is compact, unobtrusive when not in use, and does not require assembly/disassembly upon each use. Furthermore, there is a need for such a holder which presents a neat, clean appearance when in the stowed configuration. Still further, there is a need for such a holder which is durable yet economical to manufacture.

SUMMARY OF THE INVENTION

A flagpole holder includes a base mountable to a surface and a pole support pivotally attached to the base and having an opening therein for passage of a flagpole therethrough when the pole support is pivoted from a first position adjacent the base to a second position extended from the base. The flagpole holder also has a retainer orientable in a first position to hold the pole support adjacent the base by engaging the opening of the pole support. The retainer is also orientable in a second position for pivotal movement of the pole support for extension from the base when the retainer is released from the opening of the pole support. The retainer is adapted to hold an end of a flagpole when released from the opening of the pole support. The flagpole holder also includes a spring connecting the pole support and the retainer. The spring biases the retainer to engage the opening of the pole support. The spring causes pivotal movement of the pole support for extension from the base when the retainer is released from the opening in the pole support. The spring biases the retainer to hold the end of a flagpole against the base when the retainer is released from the opening of the pole support.

Preferably, the flagpole holder also includes a retainer stop on the base for limiting movement of the retainer when the retainer is released from the opening of the pole support. The spring and the retainer are preferably both located within the base and the retainer is a hook movable with respect to the base to be released from the pole support.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

A. Overview

Figure 1:
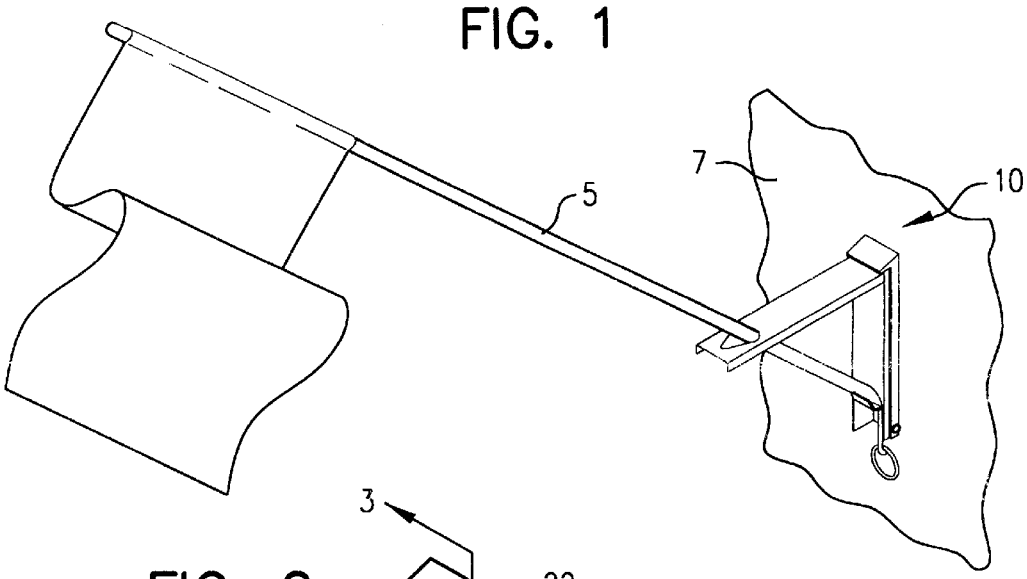
FIG. 1 is a perspective view of a flagpole holder in accordance with the present invention, showing this mounted to a vertical wall surface and deployed to engage and support the pole of a flag on display.
Figure 2:
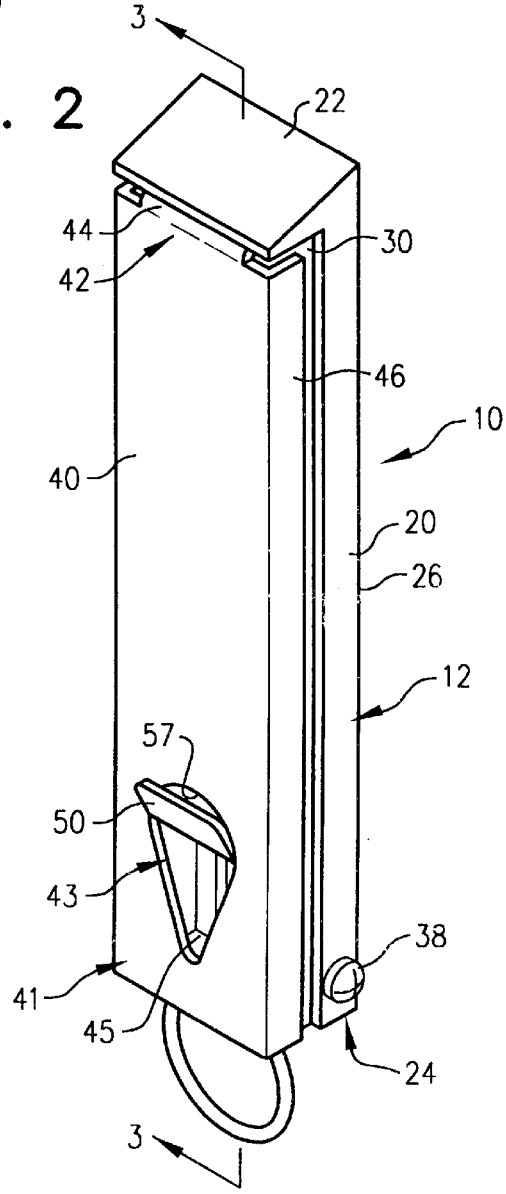
FIG. 2 is a perspective view of a flagpole holder of FIG. 1, showing this in the closed or storage position.

FIG. 1 illustrates a flagpole holder 10 in accordance with the present invention. The flagpole holder 10 is shown mounted to a wall surface 7 and holding an exemplary flagpole 5 so that this extends outwardly at an angle from the wall. This figure demonstrates the invention in use. FIG. 2, in turn, is a perspective view of the present invention in the closed or stowed position.

As will be described in greater detail below, the flagpole support 40 is formed as a general planar cover member which lies flat against the housing when the holder is in its stowed configuration, so that the holder presents a simple, unobtrusive appearance (essentially a simple rectangular box) and does not protrude excessively from the wall. The upper end of the support member 40 is hinged for pivoting movement about a horizontal axis, and the lower end has a comparatively large opening 43 which is engaged by a spring-loaded hook 50. The support pivots or "snaps" out under spring tension to a deployed position in which it extends in a generally horizontal direction. In this position, the flagpole can be inserted at a downward angle through the hole in the support and into a receiving area at the base of the housing; the spring-loaded hook, which formerly held the cover/support 40 closed, is configured to engage the end of the pole in the receiving area so as to securely retain the pole against dislodgement.

B. Structure

The flagpole holder 10 of the present invention includes a housing 12, the cover/pole support member 40, and a spring-loaded gripper assembly 50.

The housing 12 includes a mounting plate 20 and a cover plate 30; the housing can be formed from a single piece of material, although single piece construction tends to make assembly more difficult. The mounting plate 20 has a closed box upper end 22, an open lower end 24, two parallel side walls 26, and a back panel 28 (shown in FIG. 3). This plate is preferably formed from a length of aluminum "C" channel, with a short piece at one end being cut and bent forwardly to form the box end 22. Holes are provided in the back panel for screws 29 (see FIG. 3) or other fasteners for mounting the assembly to a wall or other vertical support.

The housing cover 30 is also preferably formed from aluminum "C" channel material. This channel is sized to allow housing cover plate 30 to next tightly inside mounting plate 20. The plate cover 30 has a front panel portion 32, and two side walls 34 which extend substantially the full length of the housing. A portion of the upper end 36 of the front plate is removed so as to form a slot 39 between the box end 22 of the mounting plate and the tapered edge 36 of the cover 30. Additionally, a portion is removed from the lower end 37 of the front plate 32 so that the gripper assembly 50 can engage the edge of hole 43 and thereby retain the support member 40 in the stowed position. To assemble the device, the upper edge of the housing cover 30 is slipped inside the box end 22 of the mounting plate, and then a retaining screw 38 is tightened to hold these pieces together. Consequently, cover plate 30 and mounting plate 20 cooperate to form a generally hollow housing having a closed upper end.

The outer cover/support member 40, in turn, includes upper and lower ends 41, and two side edges 46. An angled extension 44 from the upper end of the support member forms a first part of the hinge mechanism. The lower end 41, in turn, is provided with the large opening, this having a diameter which is selected to be large enough for the flagpole 5 to be inserted at an angle therethrough, yet small enough that the pole will not move or "wobble" excessively in the hole.

Moreover, as can be seen in FIG. 2, the opening 43 (although it can be circular) preferably has a teardrop shape, tapering downwardly to a narrow lower end 45. This permits the holder assembly to be used with flagpoles having a wider range of diameters than would be possible with a circular opening (which may still be used in some embodiments), while maintaining the poles at about the same, optimized outward angle from the wall. The flagpole support member 40 is preferably formed from another piece of aluminum "C" channel of similar section to that which is used to form the mounting plate 20, with the side walls 46 fitting over the edges of the cover plate 32. The material selected for the support member 40 must be substantially rigid and have adequate strength for the anticipated loading of the member by the flagpole 5 in a variety of wind conditions.

Figure 3:
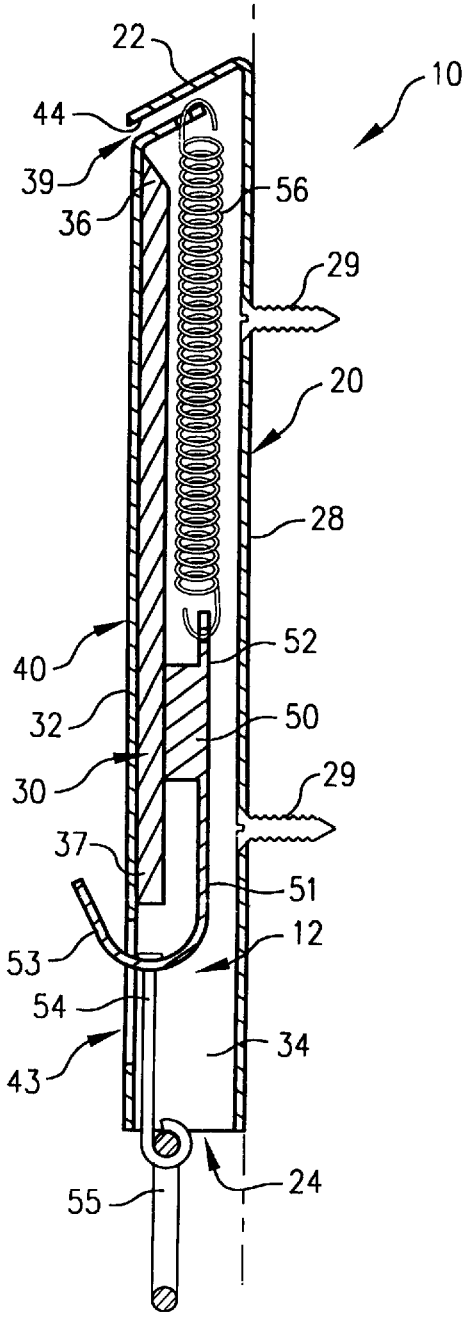
FIG. 3 is a cross-sectional view taken along line 3—3 of the holder shown in FIG. 2, showing the holder in the closed position.

As was noted above, the gripper assembly 50 is used to keep the holder 40 in a stowed position, and also to grasp the base of the flagpole when the assembly is in the deployed configuration. As can be seen in FIG. 3, the gripper assembly is made up of a grip member 51, a link member 54, a pull ring 55, and a tension spring 46. The grip member 51 includes a hook portion 53 at its end. The upper end of the grip member is received within the housing 12 and is configured so that it can slide freely in a vertical direction. The upper end of the grip member is attached to the lower end of the tension spring 56, the upper end of the spring being attached to an inwardly bent extension 44 of the support member 40, which extends into the interior of the housing through the slot 39 above the upper edge of plate 32.

The hook portion 53 of the grip member is shaped such that it can engage the end of a flagpole by pinching this against the lower end 37 of the plate 32. Also, when the assembly is not in use, the hook portion 53 engages the upper edge 57 of opening 43 so as to keep cover support 40 in the closed position. The link 54 connects the lower end of the grip member to a pull ring 55, which enables an operator to release the support 40 by pulling the grip member downwardly.

C. Operation

Figure 4:
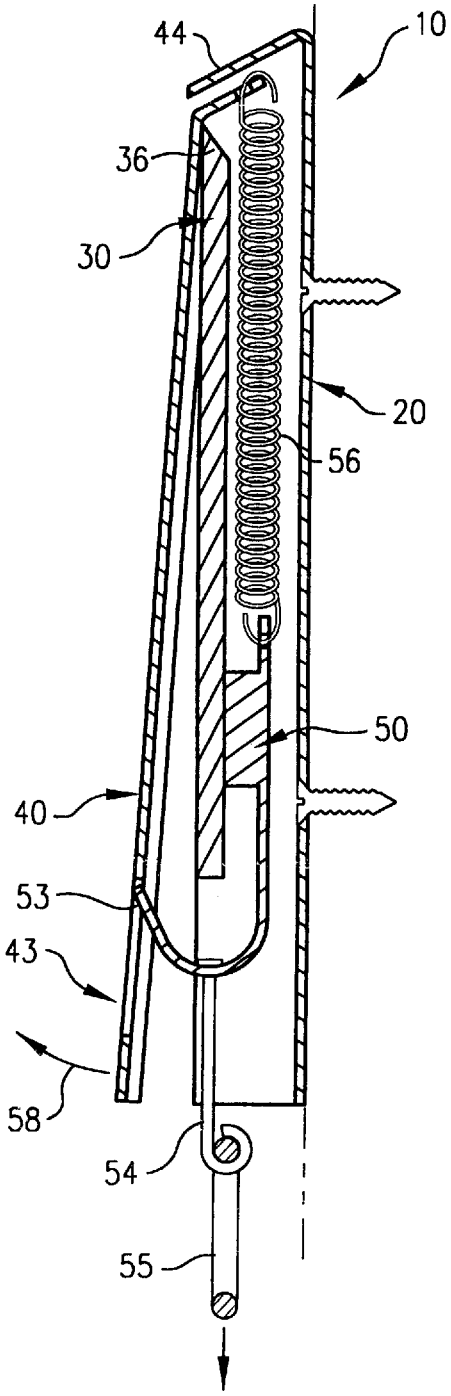
FIG. 4 is a cross-sectional view taken along line 3—3 of the holder shown in FIG. 2, with the pole gripper assembly being pulled down, so that the springloaded support member is released and self-deployed to its support position.

FIG. 4 demonstrates ring 55 having been pulled downwardly by an operator, whereby the hook portion 53 of the gripper assembly 50 clears the upper edge 57 of opening 43 so as to release support member 40. As this is done, tension spring 56 exerts a downward force on the inwardly-angled extension 44 of support member 40, causing the support member to pivot over the upper edge 36 of cover plate 32, in a manner similar to a hinge action, so that the pole support member rotates outwardly to its deployed position in the direction indicated by arrow 58.

Figure 5:
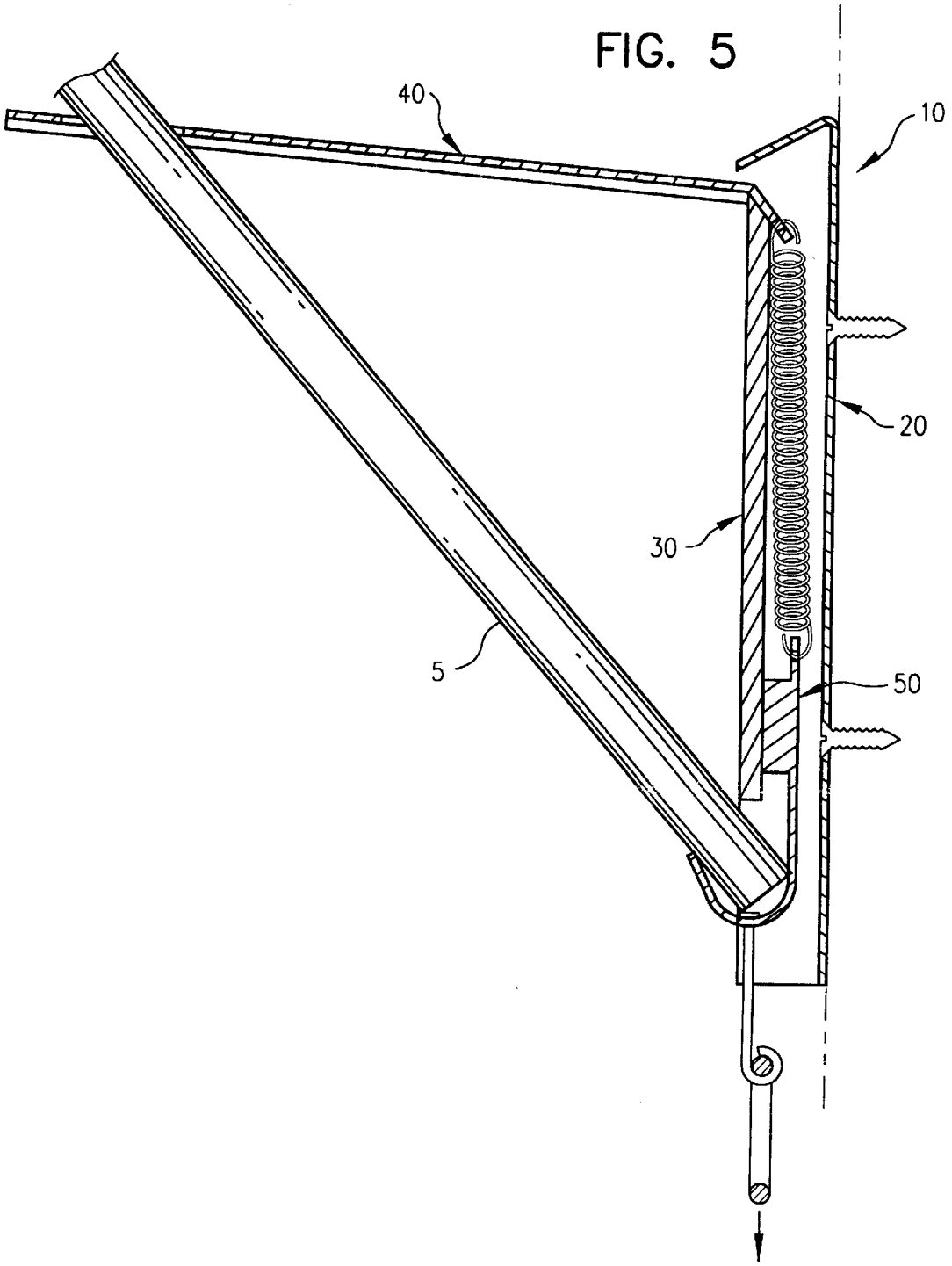
FIG. 5 is a cross-sectional view taken along line 3—3 of the holder shown in FIG. 2, with the flagpole support member deployed and a flagpole inserted therein in the position shown in FIG. 1.

FIG. 5 is a vertical cross-section of the flagpole holder in its deployed configuration, showing this holding flagpole 5. In particular, FIG. 5 illustrates the manner in which the end of the flagpole is engaged between the hook portion of the gripper assembly and the lower edge of the cover plate 30, the former being pressed forcibly against the pole by the tension of spring 56.

D. Additional Features

Figure 6:
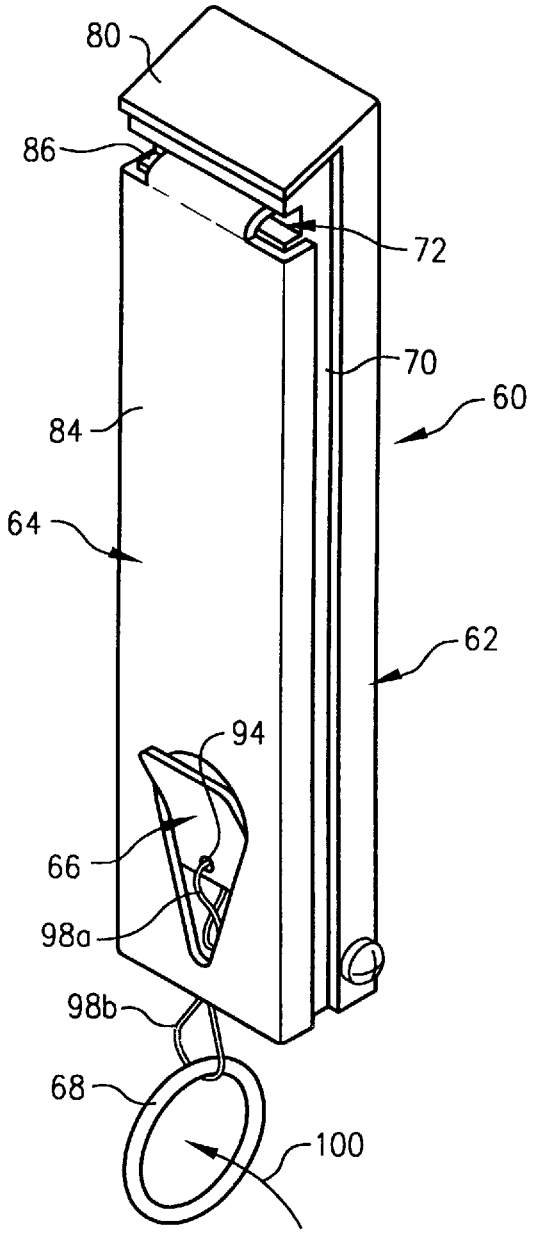
FIG. 6 is a perspective view of a flagpole holder in accordance with a second embodiment of the present invention, in which there is a slot at the upper end of the cover plate through which the end of the pivoting support member extends, rather than bearing directly against the forwardly bent end of the back plate itself.
Figure 7:
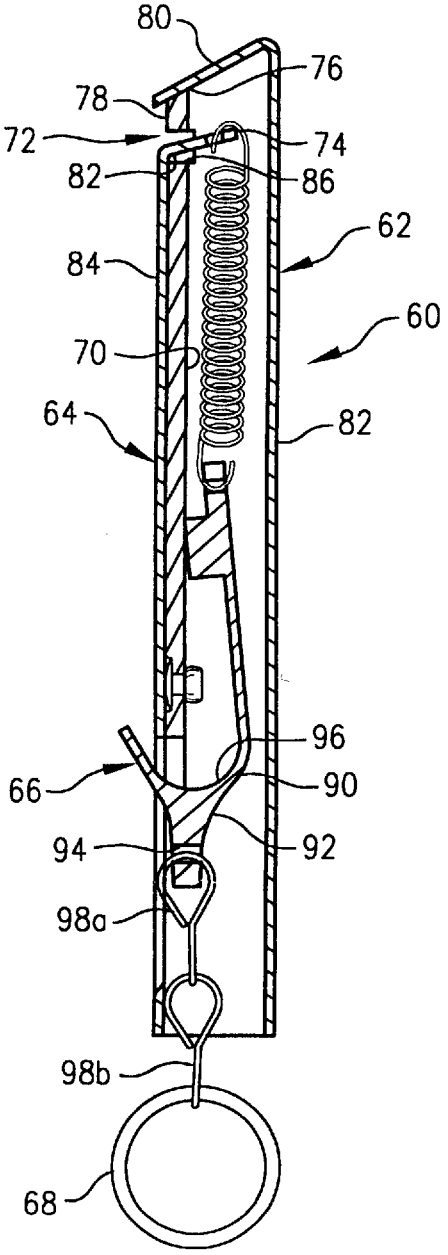
FIG. 7 is a side view of a cross-section taken vertically through the flagpole holder of FIG. 6, showing the internal components thereof with the assembly in the retracted/folded configuration.
Figure 8:
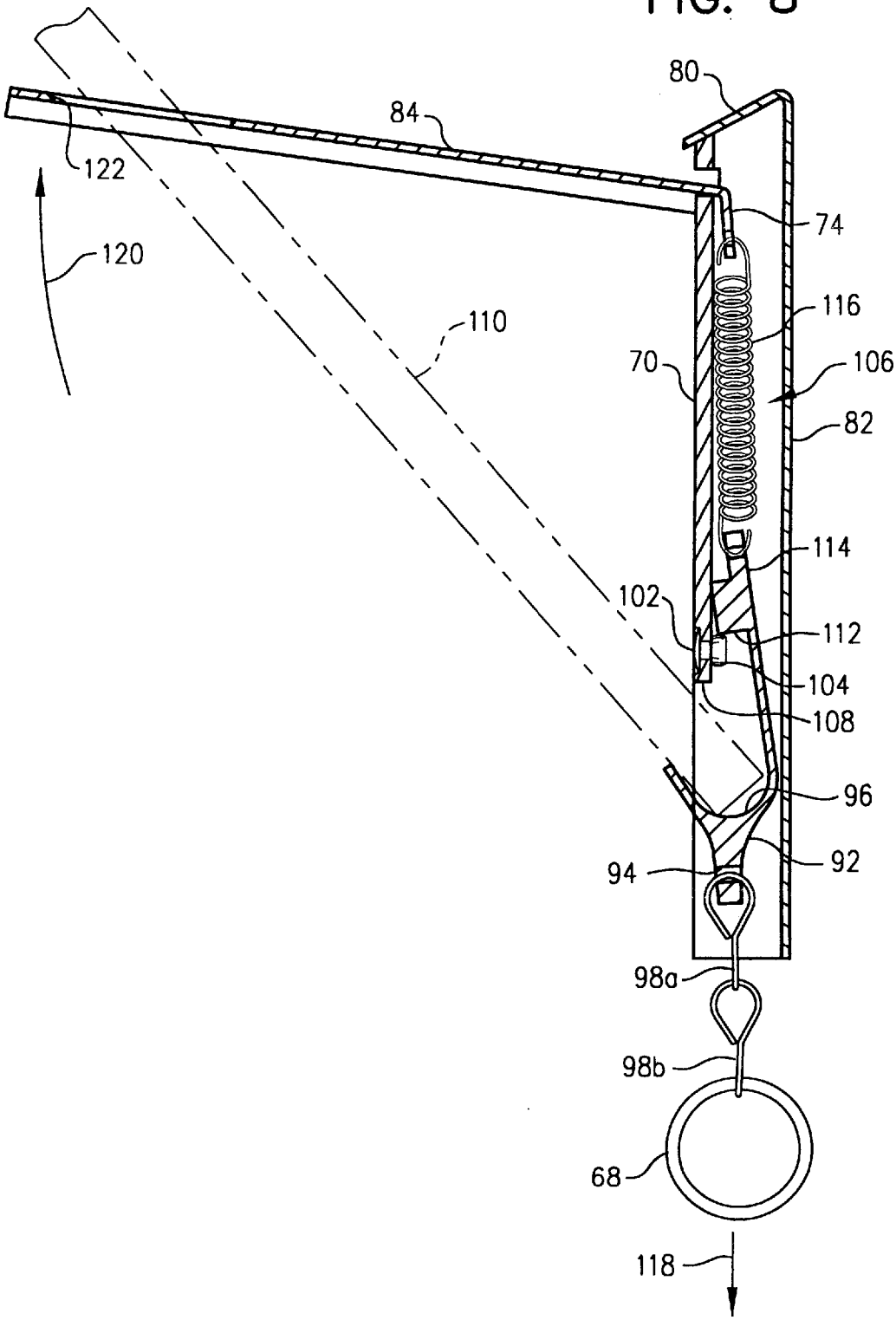
FIG. 8 is a side view of a cross-section taken vertically through the flagpole holder of FIGS. 6–7, showing the internal components thereof with the assembly in the released/extended configuration.

FIGS. 6–8 show a flagpole holder 60 in accordance with a second embodiment of the present invention, which is substantially similar to that described above in that this includes a wall-mountable housing 62, an extensible cover/ support member 64, and a spring-loaded gripper assembly 66 which is actuated by a pull ring 68. The embodiment of the invention which is shown in FIGS. 6–8, however, incorporates several additional features which enhance the durability and service life of the unit.

In particular, the housing cover 70 has a horizontal slot 72 for receiving the end 74 of the extensible support member cut near, but a short distance below, its upper edge 76, so as to form a stop portion 78 which arrests the upward and outward pivoting motion of the spring-loaded support member when the latter is released. As with the embodiment described above, the angle 82 between the front portion 84 and inwardly-extending tab portion 74 of the support member 64 forms a horizontally extending "hinge" joint against the upper edge 86 of the cover plate, on which the support member pivots between its retracted and extended positions. The stop portion 78 absorbs the impact when the support member reaches the end of its travel upon extension, rather than this impact being transferred directly to the forwardly-angled extension 80 of the mounting plate 82, so as to prevent the former from becoming deformed or bent upwardly by repeated impact forces over time.

An additional feature of the embodiment which is shown in FIGS. 6–8 is the somewhat more heavily constructed hook member 90 of the gripper assembly 66, this having a depending tongue portion 92 with a horizontal bore 94 in its lower end for attachment of the pull ring 68. The tapering configuration of the tongue portion 92 serves to provide additional material thickness on the back sides of the concave pole engagement area 96 off the hook member, and also evenly distributes downward tension forces across the bottom of the hook member, so as to eliminate the possibility of the hook member deforming or spreading apart over time.

Also, as can be seen in FIGS. 6–7, the use of jack chain links 98*a*, 98*b* to suspend the pull ring 68 from the hook member makes it possible to align the ring in a plane perpendicular to the wall surface, so as to permit the operator to conveniently pass an index finger through the ring from the side, in the direction indicated by arrow 100 in FIG. 6, while facing towards the wall on which the holder is mounted.

Furthermore, as can be seen in FIGS. 7–8, the holder 60 is provided with a pop rivet 102 or similar structure (e.g., a screw or bolt) which is installed towards the lower end of cover plate 70, so that the inner end 104 thereon protrudes into the hollow interior 106 of the housing a short distance above the upper edge 108 of the gripper opening. As can be seen in FIG. 8, the inwardly protruding end of the rivet reacts against a forwardly protruding shoulder 112 on the upper end 114 of the hook member 90, so as to provide a stop which prevents the hook member from being pulled out of the housing or the tension spring 116 from being overstretched as the pull ring 68 is drawn downwardly in the direction indicated by arrow 118.

When the ring 68 is pulled downwardly as shown in FIG. 8, this releases the support member 84 to pivot outwardly and upwardly from its stowed position, under the influence of tension spring 116 acting on the inwardly protruding end 74 of the member, in the direction indicated by arrow 120. As with the embodiment described above, this serves to locate the teardrop-shaped opening 122 in the support member at a position which is spaced outwardly and above the receiving area 96 in the hook member, so that the flagpole 110 can be inserted through the opening and into the gripper assembly and held firmly therein at the desired angle (e.g., approximately 45 degrees from vertical in the embodiment which is illustrated).

Although the flagpole holder of the present invention has been described herein with particular reference to an exemplary embodiment which is constructed of aluminum alloy, it will be understood that the holder may be constructed from any suitable material with sufficient strength and corrosion resistance for the particular application. These materials can include, but are not limited to, various steels, plastics, and composites.

While the preferred embodiment of the invention has been illustrated and described, it will be appreciated that various changes can be made therein without departing from the spirit and scope of the invention.

I claim:

1. A pole holder comprising:

a base mountable to a surface;

a pole support pivotally attached to said base and having an opening therein for passage of a pole therethrough when said pole support is pivoted from a first position adjacent said base to a second position extended from said base;

a retainer orientable in a first position to hold said pole support adjacent said base by engaging said opening of said pole support and orientable in a second position for pivotal movement of said pole support for extension from said base when said retainer is released from said opening of said pole support, said retainer adapted to hold an end of a pole when released from said opening of said pole support; and spring means connecting said pole support and said retainer, said spring means biasing said retainer to engage said opening of said pole support, said spring means causing pivotal movement of said pole support for extension from said base when said retainer is released from said opening in said pole support, said spring means biasing said retainer to hold an end of a pole against said base when said retainer is released from said opening of said pole support.

2. The pole holder of claim 1, further comprising:

a retainer stop on said base for limiting movement of said retainer when said retainer is released from said pole support.

3. The pole holder of claim 1, wherein said spring means is located within said base.

4. The pole holder of claim 1, wherein said retainer is a hook movable with respect to said base to be released from said pole support.

5. The pole holder of claim 1, wherein said retainer is located substantially in said base.

6. The pole holder of claim 1, wherein said spring means is a single spring.

7. A pole holder comprising:

a base mountable to a surface;

a pole support pivotally attached to said base and having an opening therein for passage of a flagpole therethrough when said pole support is pivoted from a first position adjacent said base to a second position extended from said base;

a retainer orientable in a first position to hold said pole support adjacent said base and orientable in a second position for pivotal movement of said pole support for extension from said base; and spring means connecting said pole support and said retainer, said spring means biasing said retainer to engage said pole support, said spring means causing pivotal movement of said pole support for extension from said base when said retainer is released from said pole support.

8. The pole holder of claim 7, further comprising:

a retainer stop on said base for limiting movement of said retainer when said retainer is released from said pole support.

9. The pole holder of claim 7, wherein said spring means is located within said base.

10. The pole holder of claim 9, wherein said spring means is a single spring.

11. The pole holder of claim 7, wherein said retainer is a hook movable with respect to said base to be released from said pole support.

12. The pole holder of claim 7, wherein said retainer is located substantially in said base.

13. The pole holder of claim 7, wherein said retainer engages said opening of said pole support when said pole support is oriented adjacent said base.

14. The pole holder of claim 7, wherein said retainer is adapted to hold an end of a pole when released from said pole support.

* * * * *